US006568994B1

(12) United States Patent
Shaw

(10) Patent No.: US 6,568,994 B1
(45) Date of Patent: May 27, 2003

(54) SHIFTING EDGE SCRUBBING

(75) Inventor: James S. Shaw, Hampton Falls, NH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/379,918

(22) Filed: Aug. 24, 1999

(51) Int. Cl.[7] ..... B24B 1/00

(52) U.S. Cl. ..... 451/36; 451/38; 451/39; 451/84

(58) Field of Search ..... 451/36, 38, 39, 451/84, 94, 271

(56) References Cited

U.S. PATENT DOCUMENTS

| | | | | |
|---|---|---|---|---|
| 5,146,716 A | | 9/1992 | Lynn | |
| 5,207,034 A | | 5/1993 | Lynn | |
| 5,234,470 A | | 8/1993 | Lynn | |
| 5,247,766 A | | 9/1993 | Kildea | 51/317 |
| 5,279,075 A | | 1/1994 | Sage et al. | 51/165.71 |
| 5,364,472 A | * | 11/1994 | Heyns et al. | |
| 5,791,976 A | * | 8/1998 | Honda | |
| 5,810,644 A | * | 9/1998 | Schmidt | |
| 5,833,516 A | * | 11/1998 | De Haas et al. | |
| 6,012,968 A | * | 1/2000 | Lofaro | |

FOREIGN PATENT DOCUMENTS

| | | |
|---|---|---|
| EP | 0178164 A | 4/1986 |
| EP | 0430856 A | 6/1991 |

OTHER PUBLICATIONS

U.S. patent application Ser. No. 09/217,672, filed Dec. 21, 1998, entitled "Free Flow Abrasive Hole Polishing," Inventor: James S. Shaw, General Electric Company assignee.
Sponge–Jet, Inc., "Sponge Blasting System," brochure, 1997.
Sponge–Jet, Inc, "Material Safety Data Sheets," Aug. 30, 1996.
Sponge–Jet, Inc. "Case Histories," undated.
U.S. patent application Ser. No. 09/358,643, filed Jul. 23, 1999.
U.S. patent application Ser. No. 09/379,917, filed Aug. 24, 1999.

* cited by examiner

*Primary Examiner*—Joseph J. Hail, III
*Assistant Examiner*—Willie Berry, Jr.
(74) *Attorney, Agent, or Firm*—V G Ramaswamy; Francis L. Conte

(57) ABSTRACT

A workpiece includes an aperture bordering a surface at a shifting edge. A stream of pliant shot is discharged in a carrier fluid at the edge with a shallow angle of incidence. And, the workpiece is rotated to sweep the shot stream along the shifting edge for abrasion thereof.

20 Claims, 4 Drawing Sheets

SHIFTING EDGE SCRUBBING

BACKGROUND OF THE INVENTION

The present invention relates generally to manufacture and repair of machine parts, and, more specifically, to surface finishing of such parts.

Machines are assemblies of various parts which are individually manufactured and assembled. Machines typically include metal parts, although synthetic and composite parts may also be used. And, each part requires specialized manufacturing.

For example, metal parts may be fabricated from metal stock in the form of sheets, plates, bars, and rods. Metal parts may also be formed by casting or forging. Such parts may be machined to shape in various manners.

Machining requires the selective removal of material to configure the part to its final shape and size within suitable manufacturing tolerances, typically expressed in mils, and with a suitable surface finish which is typically smooth or polished without blemish.

Each step in the manufacturing process of machine parts adds time and expense which should be minimized for producing a competitively priced product. It is desirable for each subsequent step in the manufacturing process to avoid damaging previously finished portions of the part which would then require additional corrective finishing steps.

Gas turbine engines are an example of a complex machine having many parts requiring precise manufacturing tolerances and fine surface finishes. A typical engine includes a multistage compressor for pressurizing air which is mixed with fuel in a combustor and ignited for generating hot combustion gases which flow downstream through one or more turbine stages that extract energy therefrom. A high pressure turbine powers the compressor, and a low pressure turbine provides output power, such as powering a fan disposed upstream from the compressor in an aircraft engine application.

The engine thusly includes various stationary components, and various rotating components which are typically formed of high strength, state of the art metal and composite materials. The various parts undergo several steps in their manufacturing and are relatively expensive to produce.

Of particular interest in manufacturing compressor and turbine rotor disks is maintaining smooth surface finish thereof and large radii along edges therein for minimizing stress during operation. Rotor disks support corresponding rotor blades around the perimeters thereof, and are subject to substantial centrifugal force during operation. The centrifugal force generates stress in the rotor disk which can be concentrated at sharp edges or small comers in the disk, which must therefore be suitably eliminated.

In one type of rotor disk, axial dovetail slots are formed through the perimeter of the disk for retaining rotor blades having corresponding axial dovetails. The dovetails include one or more pairs of dovetail tangs, in the exemplary form of a fir tree, which mate in complementary dovetail slots formed between corresponding disk posts.

The dovetail slots are typically manufactured by broaching wherein successively larger cutting tools cut the perimeter of the rotor disk to form the desired dovetail slots in a sequential operation. Each dovetail slot is broached in turn until the full complement of slots is formed around the perimeter of the disk.

The disk prior to the broaching operation has already undergone several steps in the manufacturing process including precision machining of most of its external surface. Broaching of the dovetail slots in the perimeter of the disk typically results in sharp corners or edges on the entrance side of the slot, and burrs on the exit side of the slot. The sharp entrance edges and burred exit edges require further processing to form suitably large radii which correspondingly reduce stress concentrations during operation of the rotor disk.

Deburring and radiusing of the rotor disk typically requires several additional processes in view of the complexity of the rotor disk and the complexity of the dovetail slots therein. For example, the individual rotor disk after broaching may be turned inside a bed of abrasive particles, such as the Sutton Blend (trademark) process, used to initially deburr the slots and form suitable corner radii therealong. However, the Sutton Blend process is directional and is effective for radiusing only some of the edges of the serpentine dovetail slots.

Accordingly, the disk undergoes additional processing for benching or further abrading slot edges, typically near their bases, by hand or robotically. One form of benching is conventionally known as Harperizing which is a trademark process using cloth wheels having abrasive therein.

This process is then followed by a conventional abrasive flow for blending the benched regions as required for achieving suitable radii.

These various steps require corresponding processing time, and are correspondingly expensive. And, hand benching always includes the risk of inadvertent damage to the rotor disk rendering it defective, and requiring scrapping thereof at considerable expense.

Furthermore, the rotor disk includes other machined features which may have sharp edges and burrs thereon which also require processing. For example, an annular row of axial holes extend through the web of the disk below the dovetail slots which receive retaining bolts during assembly. These bolt holes are suitably drilled, and like broaching, have sharp entrances and sharp exits with burrs thereon. These edges are also suitably radiused using the processes described above, which adds to the time and expense for disk manufacture.

The deburring and radiusing processes described above are used selectively for the edges being treated to avoid or minimize any changes to the remaining surface of the rotor disk which is typically smooth with a fine surface finish. Any damage to that finish requires additional processing and corresponding time and expense.

Accordingly, it is desired to provide an improved process for selective surface treating a workpiece, having little or no adverse effect on adjoining surface finish thereof.

BRIEF SUMMARY OF THE INVENTION

A workpiece includes an aperture bordering a surface at a shifting edge. A stream of pliant shot is discharged in a carrier fluid at the edge with a shallow angle of incidence. And, the workpiece is rotated to sweep the shot stream along the shifting edge for abrasion thereof.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
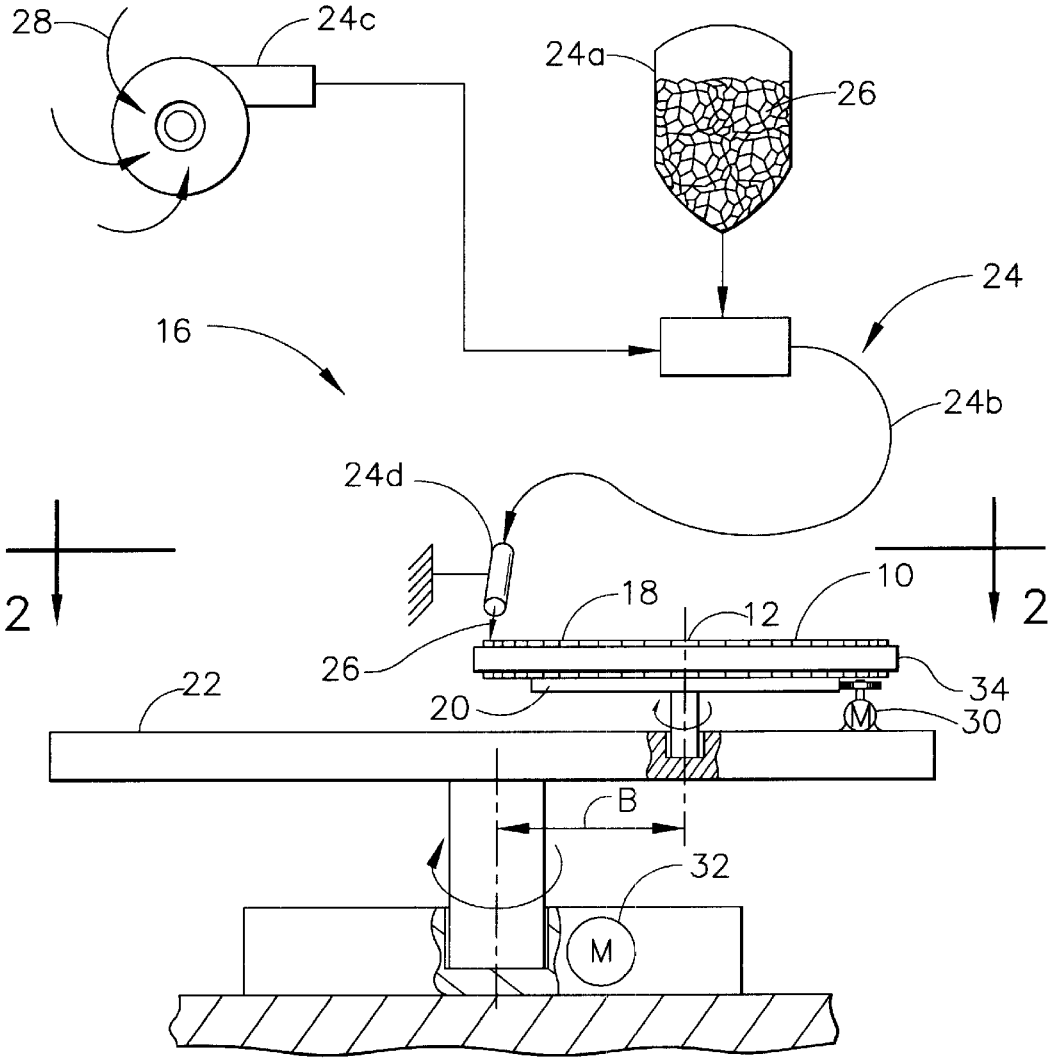
FIG. 1 is a schematic representation of an apparatus for scrubbing a workpiece in accordance with an exemplary embodiment of the present invention.

Illustrated in FIG. 1 is workpiece 10 in the exemplary form of a gas turbine engine rotor disk as may be found in a turbine or compressor thereof. The workpiece is formed of metal, although other workpieces of different configurations may be used and formed of different materials as desired.

Figure 2:
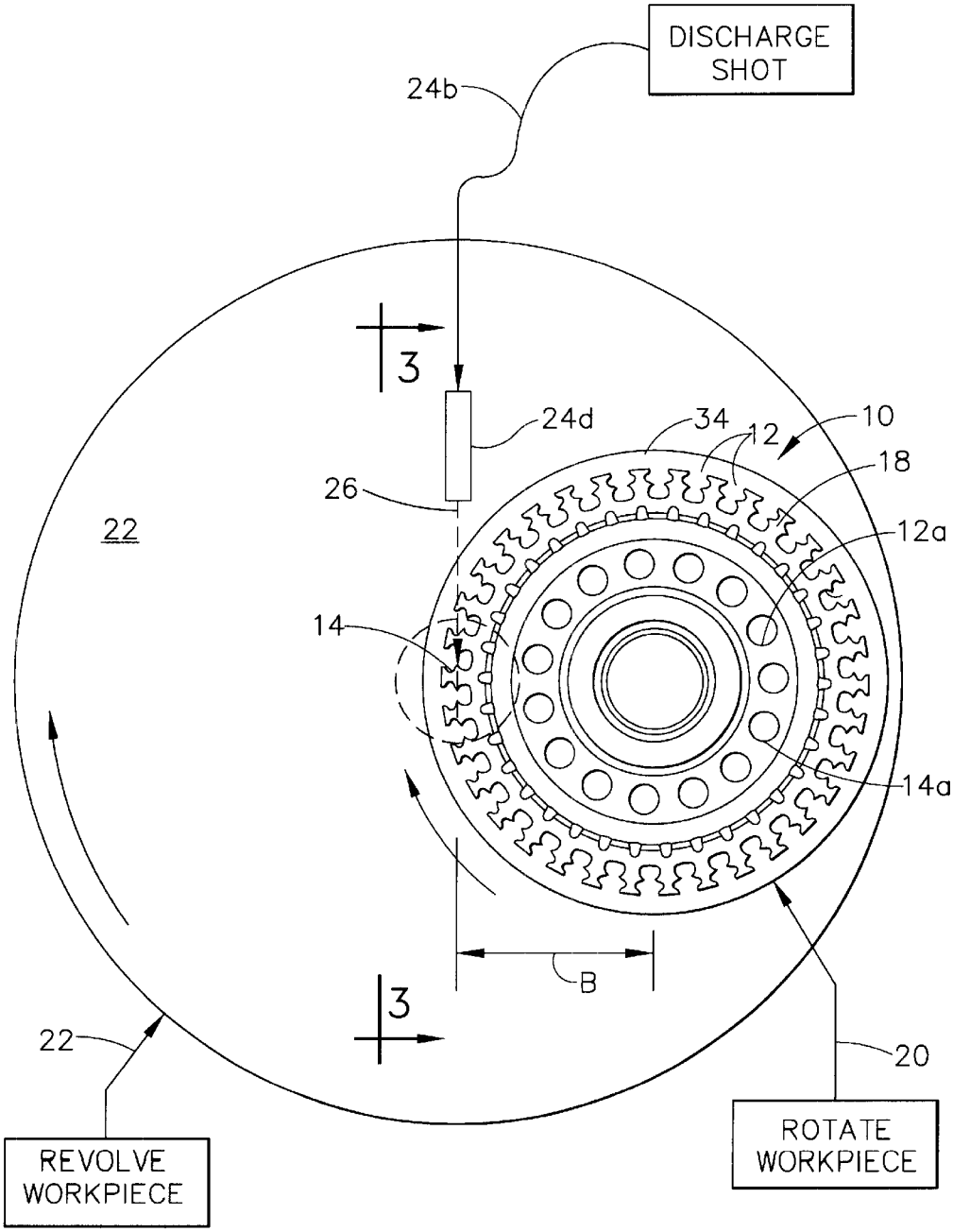
FIG. 2 is a top view of a portion of the apparatus illustrated in FIG. 1 and taken along line 2—2, showing partly in flowchart form an exemplary method of scrubbing the workpiece supported upon a pair of rotary platters.

As illustrated in more detail in FIG. 2, the disk may have any conventional form including a plurality of circumferentially spaced apart dovetail apertures or slots 12 extending axially through the perimeter thereof. The dovetail slots are typically formed by broaching in which a series of increasingly sized cutters are drawn across the perimeter of an initially solid rotor disk to form the respective dovetail slots therein. As a result of broaching, each of the dovetail slots initially has sharp edges 14, as shown in more detail in FIG. 3, at both its entrance side and exit side. The exit side of the broached dovetail slot typically also includes sharp burrs extending outwardly therefrom.

As indicated above, the rotor disk has undergone various manufacturing steps prior to broaching, and has precise dimensions and a smooth surface finish which must be protected in subsequent operations. Deburring of the broached dovetail slots is required, and the dovetail edges are typically radiused for reducing stress concentration thereat. However, deburring and radiusing typically requires multiple additional processing steps in conventional practice in view of the shifting or meandering profile of the individual dovetail slots as illustrated in more detail in FIG. 4.

Each dovetail slot is in the form of a fir tree defined between pairs of lobes or tangs in dovetail posts remaining in the disk perimeter after the broaching operation. The entrance and exit edges 14 of each dovetail slot continually shift in direction from the outer perimeter of the disk to the bases of the slots and back to the outer perimeter of the disk to correspond with the desired profile of the dovetail slots. In this way, complementary dovetails or rotor blades (not shown) are radially retained in the corresponding slots by the cooperating pressure faces defined between the dovetails and their disk slots.

The shifting profile of the individual dovetail slots increases the complexity of deburring thereof and radiusing thereof by conventional processes which are directional or subject to variation if done by hand.

Illustrated initially in FIG. 1 is an apparatus 16 specifically configured for treating a workpiece in the exemplary form of the rotor disk 10 which has one or more apertures 12 requiring deburring or radiusing thereof along the corresponding edges.

The disk 10 has two axially opposite side surfaces 18 through which the disk slots 12 extend. The disk surfaces 18 are typically premachined to a precise and smooth finish which is protected during abrasion of the dovetail slot edges.

The apparatus 16 illustrated in FIG. 1 includes a first rotary platter or turntable 20 for supporting the disk 12 thereatop. A second platter or turntable 22 is preferably provided to support the first platter. Means 24 are provided for discharging a stream of pliant or soft shot 26 in a carrier fluid 28, such as air, atop the disk for edge treatment thereof.

Additional means 30 are operatively joined between the first and second platters for rotating the first platter 20 atop the second platter 22. These means may have conventional components, including a first motor and a platter drive, to provide desired rotation of the first platter.

Further means 32 are operatively joined to the second platter 22 for rotating the second platter for revolving the first platter and disk thereatop to effect compound rotary motion at the impact site of the shot 26 atop the disk. These means may have conventional components, including a second motor and platter drive, to provide desired rotation of the second platter.

Figures 3, 5:
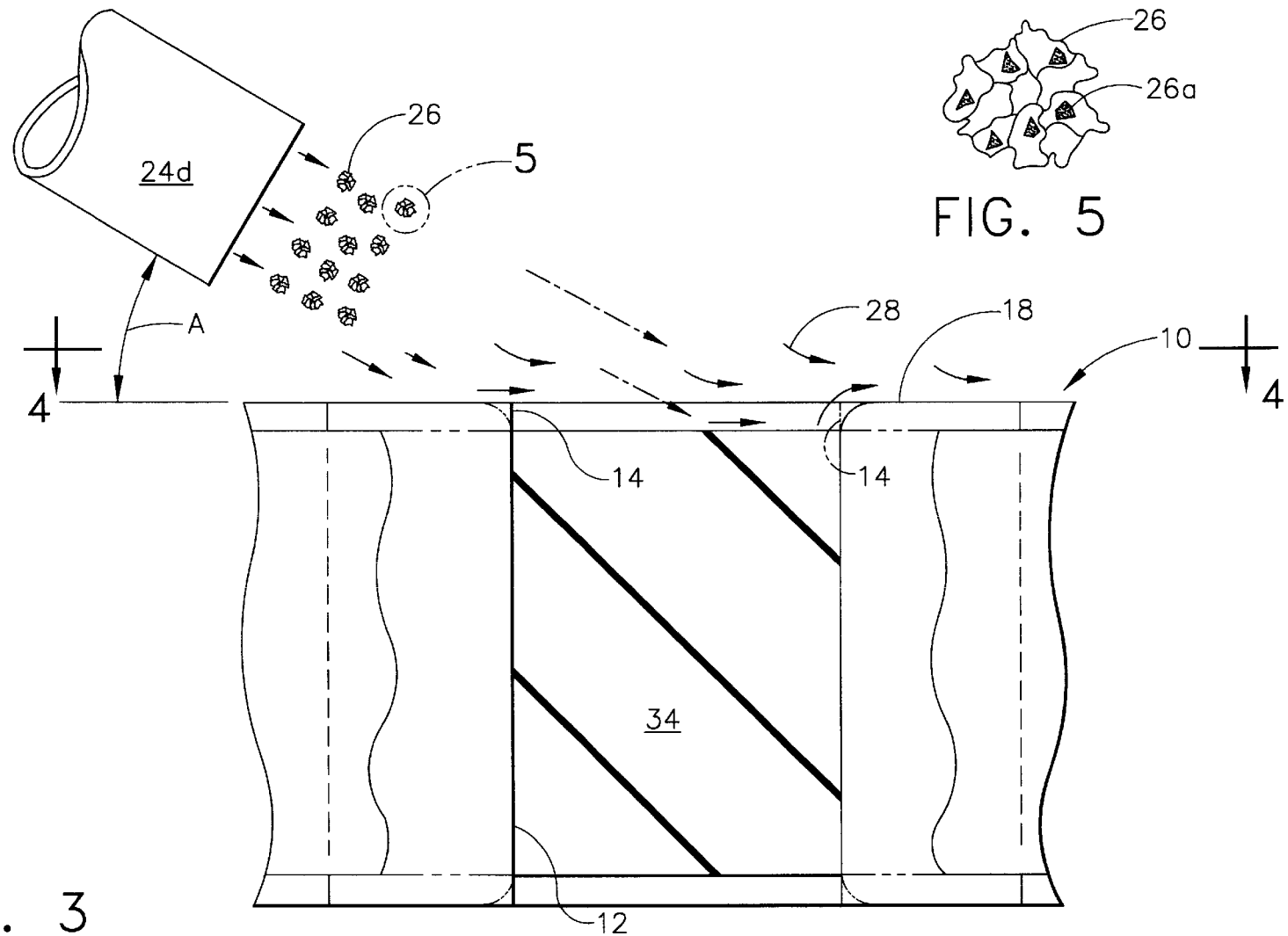
FIG. 3 is an elevational, partly sectional view of a portion of the workpiece illustrated in FIG. 2 and taken generally along line 3—3.
FIG. 5 is an enlarged view of an exemplary pliant shot illustrated in FIG. 3 within the circle labeled 5.

The impact site is illustrated in more particularity in FIG. 3 wherein a stream of the pliant shot 26 is discharged or ejected in the carrier air 28 at the slot edge 14 with a shallow angle of incidence A with or relative to the exposed disk outer surface 18.

The disk 10 is rotated atop the platters, as shown in FIGS. 1 and 2, to sweep the shot stream along each of the slot edges 14 for abrasion thereof to deburr or radius as desired.

As shown in FIG. 3, the pliant shot 26 may be used to quickly and safely remove burrs and the sharp corners at the slot edges 14 while providing little or no damage to the finish of the exposed disk surface 18 adjoining the slots. The pliant shot 26 and shallow incidence or surface angle A cause scrubbing of the shot laterally along any portion of the surface 18 impacted for selectively removing target material from only protrusions, such as the slot edges 14 facing the shot stream.

The shot 26 is pliant and resilient, and initially compresses as it impacts the disk surface with little or no rebounding in the region of the impact site. The shallow incidence angle A ensures that the shot is scrubbed generally parallel to the disk surface 18 for the protection thereof, while then traveling in impingement against any protruding target, such as the slot edges 14 which define discontinuities in the disk surface.

As shown in magnification in FIG. 3, the stream of shot 26 has a suitably large spread to impact the disk surface over a corresponding impact site including one or more of the dovetail slots 12. The pliant shot compress as they engage the disk surface and travel parallel therealong due to their kinetic energy, as well as the blanket of carrier fluid 28 which flows thereover. In this way, Sustained Surface Scrubbing ($S^3$) is effected for maintaining the stream of shot over a finite distance along the disk surface with little or no appreciable rebounding therefrom.

In the preferred embodiment illustrated in FIG. 5, the shot 26 comprises a light-weight, resilient material such as sponge, rubber, felt, plastic, foam, or other resilient material. The shot may have open or closed cells. The shot 26 preferably includes abrasive particles 26*a* imbedded therein, although in alternate embodiments abrasive may be omitted. Suitable abrasives include particles of various minerals, metal oxides, plastics, and black walnut shell, for example.

One type of suitable pliant shot is commercially available from Sponge-Jet Inc. of Eliot, Me. under the tradename of Sponge Media. This sponge media includes a polyurethane open-cell carrier in which is impregnated different types of abrasive material for different abrasive performance. And, one form of the sponge media is without abrasive.

Equipment 24, as illustrated in FIG. 1 for discharging the pliant shot is also commercially available from Sponge-Jet Inc., but is modified and operated differently for purposes of the sustained surface scrubbing of the present invention. In conventional practice, the sponge media is blasted perpendicularly, or close thereto, against a surface of a workpiece for removing coatings thereof while profiling the underlying surface.

Accordingly, impingement of the sponge media not only removes coatings atop the surface, but also removes underlying material of the surface itself which changes its surface finish.

As indicated above, the rotor disk 10, as an exemplary workpiece, typically has a finished surface which is preferably protected when removing the target material therefrom. Since the target material includes burrs or sharp corners along the dovetail edges 14, suitable discrimination between the adjoining surface, having the same material composition, is required to prevent damage to that surface or change in its surface finish.

The blasting apparatus 24 illustrated in FIG. 1 is conventional in structure and includes a hopper 24*a* in which the pliant shot 26 is stored. The hopper is joined in flow communication with a delivery conduit 24*b* through which the shot is discharged.

An air compressor or pump 24*c* is operatively joined to the delivery conduit 24*b* for providing air as the carrier fluid 28 under suitable pressure for carrying and discharging the shot in a stream through a nozzle 24*d*. The nozzle may have any suitable configuration for discharging the shot 26 in a suitably wide stream for decreasing overall processing time. And, low air pressure of about 30–40 psi is preferred to discharge a uniform dispersion of the shot.

The nozzle 24*d* illustrated in FIG. 1 is preferably fixedly mounted to a suitable stationary support, and aimed or directed at the desired region of the rotor disk 10 for undergoing scrubbing thereof.

As shown in more detail in FIG. 3, the nozzle 24*d* is oriented relative to the disk surface 18 for discharging the shot 26 at the shallow incidence angle A. In one embodiment tested, the incidence angle A was about 30°, and the shot was observed as maintaining scrubbing contact on a flat surface without appreciable rebound for at least several centimeters. Sustained surface scrubbing was also obtained at an incidence angle of about 45° on the flat plate.

The incidence angle A may be varied along with the operating air pressure of the delivery apparatus 24 and the type of pliant shot used, and may range up to about 60°, for example. The limit on the incidence angle A is that angle at which the shot experiences rebounding off the adjoining disk surface 18 surrounding the dovetail slots, with a corresponding loss in lateral or sustained scrubbing thereof. And, shallow incidence angles should be used to prevent the abrasive from imbedding in the disk surface 18.

Impingement of the shot causing rebounding thereof atop the disk surface is undesirable since the material-removal performance of the shot then occurs in similar amounts along the slot edges 14 and the adjoining disk surface 18 within the impact site of the shot stream. And, normal to the surface impingement of abrasives is undesirable since the abrasive may become imbedded in the workpiece surface 18.

In contrast, sustained surface scrubbing carries the shot 26 illustrated in FIG. 3 generally parallel along the exposed surface 18 of the disk with little or no material removal therefrom, while laterally impinging the slot edges 14 which effectively protrude into the incident shot 26. Deburring and radiusing of the sharp slot edges 14 is readily effected without significantly affecting the disk surface 18, which maintains its smooth finish without adverse affect from the shot.

Although the incidence angle A of the shot 16 atop the disk surface 18 illustrated in FIG. 3 is preferably shallow for protecting the disk surface, selective abrasion of the slot edges 14 is effected by ensuring that the shot 26 is directed thereagainst substantially perpendicular or normal thereto. This is additionally illustrated in FIGS. 2 and 4 wherein the shot 26 is directed tangentially along the disk at the disk slots.

Since each slot 12 has a shifting or meandering edge 14 which outlines the required dovetail shape thereof, one, and preferably both, of the platters 20,22 are provided for rotating the disk 10 to position the shifting edges 14 substantially normal to the shot stream. Since the dovetail slots and their shifting edges are repetitive around the perimeter of the rotor disk, the disk 10 is preferably rotated to sequentially position each of the slots 12 within the shot stream for respectively abrading the corresponding edges 14 thereof.

The delivery nozzle 24*d* illustrated in FIGS. 1 and 2 is preferably stationary in space and directed at a fixed impact site atop a preferred location on the disk. By both rotating and revolving the disk 10 on the respective platters 20,22, sweeping of the shot stream is effected along the shifting edges 14 of the individual dovetail slots. Compound rotary movement of the disk 10 at the impact site is used to advantage to sweep the shot stream along the full shifting profile of the individual dovetail slots while being directed substantially normal to the respective portions thereof for maximizing the abrasion performance of the shot.

Figure 4:
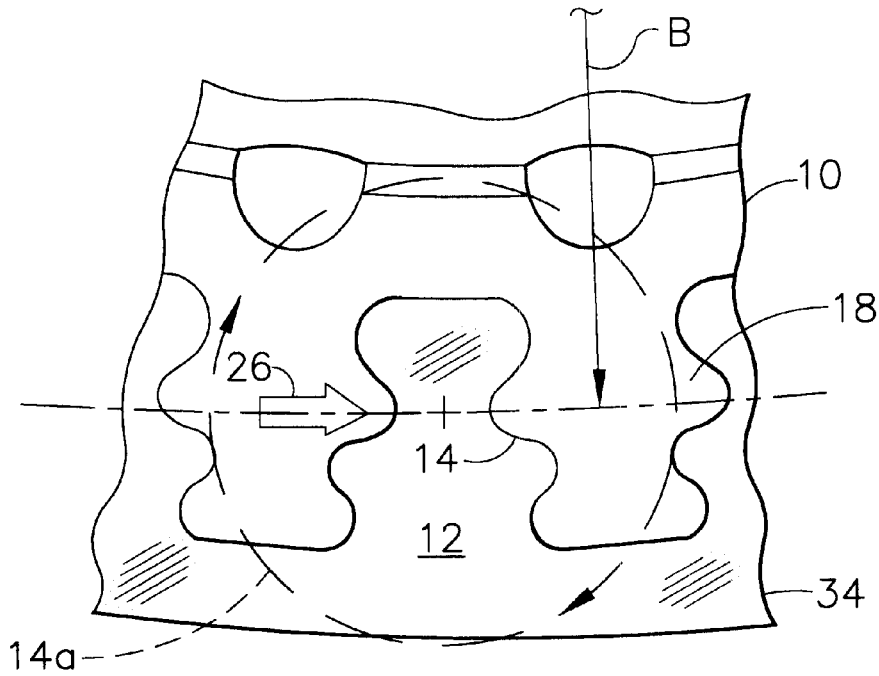
FIG. 4 is an enlarged, top view of a portion of the workpiece illustrated in FIG. 3 and taken along line 4—4.

As shown in FIGS. 2 and 4, the dovetail slots 12 are circumferentially spaced apart from each other and radially aligned at a common radius B from a center of the disk in a uniform ring arrangement. The disk 10 is then rotated about its center atop the first platter 20, and the disk center revolves around the impact site by rotation atop the second platter 22.

As initially shown in FIG. 2, the stream of shot 26 is directed tangentially near the perimeter of the disk 10 at the outer end of the common radius B to define the impact site thereat which is stationary in space but follows the perimeter of the disk as it rotates and revolves. At the impact site, the disk 10 revolves so that the shot stream is directed substantially perpendicularly along each portion of the shifting slot edge 14 over its entire length from slot-to-slot. This is indicated schematically in FIG. 4 by the arrow heads on the dashed circle 14*a* indicating the effective revolution of an exemplary dovetail slot 12 relative to the stream of shot 26.

However, the disk 10 both rotates and revolves, with rotation of the disk ensuring that each of the entire set of disk slots is treated by the shot stream so that collective rotation and revolution of the disk ensures substantially uniform scrubbing of all of the slot edges 14 within the common impact site of the shot stream irrespective of the shifting orientation of those edges.

In the preferred embodiment illustrated in FIG. 2, and in more particularity in FIG. 4, each of the disk slots 12 has a center aligned generally at the common radius B. This places the center of each disk slot above the rotational center of the second platter 22, with the shot stream being directed tangentially at the same common radius. By rotating the disk 10 illustrated in FIG. 2 about its center, and preferably revolving the disk 10 simultaneously by rotating the disk atop the second platter 22, the shot stream 26 is swept sequentially along the slot edges 14 for abrasion thereof.

It is noted, however, that the shot stream does not trace each slot edge 14 continuously as the disk turns, but in sections. Due to the compound rotation and revolution of the disk 10, the shot stream is directed at the individual dovetail slots in sequence. After several rotations of the disk, the combined effect of rotation and revolution ensures that the shot stream is directed substantially normal to all portions of the shifting edges 14 for uniform abrasion thereof.

In the preferred embodiment, the disk is rotated and revolved at different rotary speed expressed in revolutions per minute, rpm. In view of the specific geometry illustrated in FIG. 2 with the common radius B having opposite ends at the corresponding centers of the two platters 20,22, the disk 10 preferably rotates at a faster rpm atop the first platter 20 than the revolution thereof atop the second platter 22.

This is better appreciated in a simpler example such as the plurality of circumferentially spaced apart axially bolt holes 12*a* illustrated in FIG. 2. Each bolt hole is cylindrical with circular entrance and exit edges 14*a*. An exemplary one of the circular edges 14*a* is illustrated in dashed line in FIG. 4 superimposed atop the center of rotation of the second platter 22. In such a configuration, rotation of the second platter 22, without rotation of the first platter 20, merely rotates the circular edge 14*a* concentrically therewith so that each portion of the circular edge is presented normal to the incident stream of shot 26. In one revolution of the platter 22, the entire circumference of the circular edge 14*a* is swept by the shot stream.

By then rotating the disk 10 in addition to its revolution, each of the entire complement of bolt holes 14*a* may be similarly treated along their entire perimeters.

Since the disk rotates and revolves simultaneously, the edge scrubbing thereof occurs periodically from hole-to-hole until the disk has rotated a suitable number of rotations to sweep all of the edges of all the holes.

In a preferred embodiment, the rotor disk should accumulate rotations equal to at least the total number of bolt holes for each revolution of the second platter 22 to sweep all of the edges thereof. Similarly, the rotor disk should accumulate rotations equal to at least the total number of disk slots 12 for each revolution of the second platter to scrub the entire extent of all of the dovetail slots on one side of the rotor disk. The faster rotary speed of the first platter compared to the second platter ensures this desired relationship.

Although the disk slots 12 illustrated in FIG. 3 may remain empty during edge scrubbing thereof, it is preferred to fill each of the disk slots 12 with a suitable plug or filler 34 which is recessed or stepped below the adjoining disk surface 18 to expose a corner at the corresponding slot edge 14. The plug 34 may be formed by molding filler simultaneously in all of the disk slots and bolt holes as desired, and maintaining a recess below the disk surface. A suitable plug material is elastomeric, such as polyurethane rubber, which is readily moldable to the disk.

The plug 34 not only protects the inside of the individual dovetail slots 12 from abrasion from the shot 26, but also controls radiusing of the slot edges 14, and directs the shot 26 in lateral impingement thereagainst.

As shown in FIG. 3, the shot 26 is initially discharged at the shallow incidence angle A atop the disk surface and plug 34, and is then directed laterally or parallel toward the corner edge 14 for radiusing thereof. Scrubbing of the parallel surfaces has little, if any, abrasion thereof, but lateral impingement of the shot against the protruding corner edge 14 effects significant abrasion thereof, and controlled radiusing.

In this way, the shot 26 is scrubbed laterally along the plug 34 and disk surface 18 for selectively removing or abrading material at primarily only the corner edges 14. As shown in FIG. 3, the shot 26 is scrubbed parallel to those surfaces yet impinges the facing corner edge 14 for local abrasion thereof.

Since abrasion is limited to edges 14 facing the incident shot 26, the shifting directional orientation of the dovetail slot 12 must be reoriented relative to the shot stream so that all desired portions of the edge face the shot stream during some portion of the scrubbing process. The use of the two platters 20,22 in the preferred embodiment ensures that all of the dovetail edges within the impact site of the jet stream are scrubbed for equal duration and with equal effect for providing a uniform radius along the edges controlled in depth by the position of the recessed plug 34.

Accordingly, sustained surface scrubbing may be effectively applied to shifting edges of various configurations in a workpiece for controlled abrasion thereof while protecting the adjoining flat surfaces. In an annular structure, such as a rotor disk having repetitive apertures with corresponding shifting edges, compound rotation and revolution of the workpiece with a stationary injection nozzle may be used to advantage for automating abrasion treatment of the edges for enhanced uniformity thereof.

Depending upon the complexity of the shifting edges, from simple circles to complex serpentine dovetail slots, one or both of the platters 20,22 may be used to advantage for shifting edge scrubbing thereof. Edge scrubbing is thusly effected in a single processing operation that accurately and uniformly removes sharp features from apertures edges irrespective of complexity of the profile thereof. And, the edges are treated without undesirably abrading adjoining flat surfaces within the impact site of the shot stream.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

What is claimed is:

1. A method of treating a workpiece having an aperture bordering an exposed surface at a shifting edge, comprising:

discharging a stream of pliant and resilient shot in a carrier fluid laterally along said exposed surface with a shallow angle of incidence therewith for protecting said exposed surface from abrasion therefrom;

directing said shot stream along said exposed surface in impingement against said shifting edge for selective abrasion thereof; and rotating said workpiece to sweep said shot stream along said shifting edge for abrasion thereof.

2. A method according to claim 1 further comprising rotating said workpiece to position said shifting edge substantially normal to said shot stream.

3. A method according to claim 2 wherein said workpiece includes a plurality of said apertures, and further comprising rotating said workpiece to sequentially position each of said apertures within said shot stream for respectively abrading said edges thereof.

4. A method according to claim 3 further comprising rotating and revolving said workpiece to sweep said shot stream along said shifting edges of said apertures.

5. A method according to claim 4 wherein:

said apertures are circumferentially spaced apart at a common radius from a center of said workpiece; and said workpiece is rotated about said center, and said center revolves.

6. A method according to claim 5 wherein:

said shot stream is directed at said workpiece at an outer end of said common radius to define an impact site; and said workpiece revolves about said impact site.

7. A method according to claim 6 wherein each of said apertures has a center aligned generally at said common radius.

8. A method according to claim 6 wherein said workpiece is rotated and revolved to sweep said shot stream substantially normal to said shifting edges of all of said apertures in sequence.

9. A method according to claim 8 wherein said workpiece is rotated and revolved at different rpm.

10. A method according to claim 9 wherein said workpiece rotates faster than revolving.

11. A method according to claim 6 further comprising:

filling each of said apertures with a plug to provide a corner at said edge thereof; and discharging said shot stream at said shallow incidence angle atop said plug and directed toward said corner for radiusing thereof.

12. A method according to claim 11 further comprising scrubbing said shot laterally along said plug for selectively removing material at said corner.

13. A method according to claim 6 wherein said workpiece is a rotor disk, and said apertures comprise axial dovetail slots circumferentially spaced apart therearound.

14. A method according to claim 6 wherein said workpiece is a rotor disk, and said apertures comprise axial bolt holes circumferentially spaced apart therearound.

15. A method according to claim 6 wherein said shot comprises open-cell sponge.

16. A method according to claim 15 wherein said shot further comprises abrasive particles imbedded therein.

17. A method according to claim 16 wherein said sponge shot comprises polyurethane.

18. A method of treating edges of a plurality of circumferentially spaced apart apertures bordering an exposed surface in a rotor disk, comprising:

discharging a stream of pliant and resilient shot in a carrier fluid laterally along said exposed surface with a shallow angle of incidence therewith for protecting said exposed surface from abrasion thereof;

directing said shot stream along said exposed surface in impingement against one of said aperture edges for selective abrasion thereof;

rotating said disk about a center thereof; and revolving said disk to sweep said shot stream sequentially along said aperture edges for abrasion thereof.

19. A method according to claim 18 further comprising:

filling said apertures with plugs to provide corners at said edges thereof; and scrubbing said shot circumferentially along said plugs and directed toward said corners in sequence for radiusing thereof.

20. An apparatus for treating edges of a plurality of circumferentially spaced apart apertures bordering a surface in a rotor disk, comprising:

a first platter for supporting said disk;

a second platter supporting said first platter, and sized to position said disk apertures in turn atop a center thereof;

means for discharging a stream of pliant shot in a carrier fluid with a shallow angle of incidence atop said disk and at said second platter center;

means for rotating said first platter atop said second platter; and means for revolving said second platter to sweep said shot stream sequentially along said apertures edges for abrasion thereof.

* * * * *